US005653825A

United States Patent [19]

Kohno et al.

[11] Patent Number: 5,653,825

[45] Date of Patent: Aug. 5, 1997

[54] FERRITE-TYPE HOT-ROLLED STAINLESS STEEL SHEET HAVING EXCELLENT RESISTANCE TO SURFACE ROUGHENING AND TO HIGH-TEMPERATURE FATIGUE AFTER WORKING

[75] Inventors: Masaaki Kohno; Atsushi Miyazaki; Susumu Satoh; Koji Yamato, all of Chiba, Japan

[73] Assignee: Kawasaki Steel Corporation, Hyogo, Japan

[21] Appl. No.: 667,645

[22] Filed: Jun. 21, 1996

[30] Foreign Application Priority Data

Jun. 22, 1995 [JP] Japan ..... 7-156440

[51] Int. Cl.[6] ..... C22C 38/32

[52] U.S. Cl. ..... 148/320; 148/320; 420/64

[58] Field of Search ..... 148/325, 330, 148/609, 610; 420/64, 104

[56] References Cited

U.S. PATENT DOCUMENTS

| | | | |
|---|---|---|---|
| 4,515,644 | 5/1985 | Sawatani et al. | 148/610 |
| 5,492,575 | 2/1996 | Teraoka et al. | 148/609 |

FOREIGN PATENT DOCUMENTS

| | | |
|---|---|---|
| 0 492 576 | 7/1992 | European Pat. Off. . |
| 0 492 602 | 7/1992 | European Pat. Off. . |
| 0 625 584 | 11/1994 | European Pat. Off. . |
| 0 678 587 | 10/1995 | European Pat. Off. . |
| 51-014811 | 2/1976 | Japan . |
| 51-014812 | 2/1976 | Japan . |
| 52-031919 | 3/1977 | Japan . |
| 60-046352 | 3/1985 | Japan . |
| 2 071 148 | 9/1981 | United Kingdom . |

*Primary Examiner*—Deborah Yee

*Attorney, Agent, or Firm*—Young & Thompson

[57] ABSTRACT

A ferrite-type hot-rolled stainless steel sheet is composed of a selected class of elements in specified amounts. Even when cold rolling and its subsequent process steps are omitted, the hot-rolled steel sheet is sufficiently workable and excellent in surface roughening resistance and high-temperature fatigue properties after working. The steel sheet is easy to produce with a wide range of annealing temperatures.

20 Claims, 2 Drawing Sheets

FERRITE-TYPE HOT-ROLLED STAINLESS STEEL SHEET HAVING EXCELLENT RESISTANCE TO SURFACE ROUGHENING AND TO HIGH-TEMPERATURE FATIGUE AFTER WORKING

BACKGROUND OF THE INVENTION

1. Field of the Invention

This invention relates to ferrite-type hot-rolled stainless steel sheets that offer good workability and, in particular, excellent surface roughening resistance and high-temperature fatigue characteristics after working.

2. Description of the Related Art

Though somewhat less workable and less resistant to corrosion than an austenite type stainless steel, a ferrite type stainless steel is excellent in stress corrosion cracking resistance and also is inexpensive and hence has been widely applied to various kitchen fixtures and automotive exhaust components (exhaust manifolds, exhaust pipes, converter housings, mufflers and the like).

To improve the workability of such a ferrite type stainless steel sheet so as to be suitable for the above stated applications, it is common to fix impurity elements such as C and N in solid solution in the stock by the addition of elements such as Ti and Nb to a stainless steel stock. That technique is disclosed for instance in Japanese Patent Laid-Open Nos. 51-14811, 51-14812 and 52-31919. On the other hand, Japanese Patent Laid-Open No. 60-46352 discloses a highly corrosion-resistant ferrite-type stainless steel having a V content of 0.05 to 2.0% and a Cu content of 0.5 to 2.0%. This stainless steel thus has relatively high amounts of Cu so as to improve corrosion resistance. This stainless steel is exclusively useful as a cold-rolled steel material for automotive exterior trims, hot-water supply installations and other kitchen fixtures, and therefore is unconcerned with various mechanical characteristics required for a hot-rolled stainless steel, particularly high-temperature properties such as high-temperature fatigue resistance and the like.

In general, ferrite type stainless steel sheets are produced by heating a continuous casting slab and then subjecting the same to a series of process steps, i.e., hot rolling of the heated slab to obtain a hot-rolled sheet, annealing and pickling of the hot-rolled sheet, cold rolling of the annealed sheet, and final annealing and pickling of the cold-rolled sheet. If it were possible to omit any of the process steps, especially cold rolling and its subsequent steps, a conspicuous reduction of the plant investments and operating costs would be attained with respect to those omitted steps. This would mean that a ferrite type stainless steel sheet already of lower cost than an austenite type equivalent could be manufactured with further cost savings and shortened production time, and hence with great commercial merit.

Hot-rolled ferritic stainless steel sheets, however, are generally coarse in crystal grain after hot rolling and subsequent annealing as compared to cold-rolled ferritic stainless steel sheets, thus providing a steel product with a considerably roughened surface. Such crystal grain coarseness and surface roughness after working impair the aesthetic appearance of the steel product and moreover reduce the high-temperature fatigue properties of those steel components which are exposed to vibration as by engines at elevated temperatures, for example, automotive exhaust parts (exhaust pipes and the like). The last-mentioned phenomenon may be explained by the fact that, in a high-temperature fatigue environment, fatigue failure more readily occurs at grain boundaries than within crystal grains in a steel structure composed of large crystal grains, or such failure results from stresses localized on the roughened surface of the steel sheet.

The crystal grain sizes, which are closely associated with the surface roughening and fatigue failure of a steel sheet after working, may be adjusted to some degree with the varying temperatures and times for annealing. However, when annealed at a lower temperature and for a shorter time in order to render the crystal grain sizes microcrystalline, the steel sheet fails to completely recrystallize and keeps hot-rolled band structure in the vicinity of a central portion in the direction perpendicular to the plate thickness. This problem is responsible for a decrease of Rankford's value (r value) taken as a measure of deep drawing and elongation (El) and hence causes insufficient working performance. Consequently, good workability and excellent resistance to surface roughening and to high-temperature fatigue are difficult to achieve in a well-balanced manner with a ferrite type hot-rolled stainless steel sheet, and this poses a serious bottleneck in using the steel sheet for automotive exhaust parts requiring for those characteristics.

SUMMARY OF THE INVENTION

The present invention, therefore, provides a ferrite-type hot-rolled stainless steel sheet which is greatly resistant to surface roughening and to high-temperature fatigue after working and is highly workable even after omitting cold rolling and subsequent process steps.

As a result of intensive research made to achieve the above object and leading to the invention, the present inventors have found that a ferrite-type hot-rolled stainless steel sheet capable of exhibiting both excellent resistance to surface roughening and to high-temperature fatigue after working and good workability can be attained by fixing C and N of a starting steel stock by the addition of Ti and by adjusting the chemical composition of the steel stock in a specific range of constituent elements with the addition of V and B.

In one aspect, the present invention provides a ferrite-type hot-rolled stainless steel sheet that has excellent resistance to surface roughening and to high-temperature fatigue after working, which stainless steel sheet comprises, by weight, C in a content of not more than 0.03%, Si in a content of not more than 2.0%, Mn in a content of not more than 0.8%, S in a content of not more than 0.03%, Cr in a content of from 6 to 25%, N in a content of not more than 0.03%, Al in a content of not more than 0.3%, Ti in a content of not more than 0.4%, V in a content of from 0.02 to 0.4% and B in a content of from 0.0002 to 0.0050%, wherein the following formulae are satisfied, $Ti/48>N/14+C/12$ and $V/B>10$, the balance being Fe and inevitable impurities.

In another aspect the invention provides a ferrite-type hot-rolled stainless steel sheet that has excellent resistance to surface roughening and high-temperature fatigue after working, which hot-rolled stainless steel sheet further includes, by weight, Nb in a content of not more than 0.05% or one or more elements selected from Ca in a content of not more than 0.01%, Mo in a content of not more than 2.0% and Cu in a content of not more than 0.4%.

In a further aspect the invention provides a ferrite-type hot-rolled stainless steel sheet that has excellent resistance to surface roughening and to high-temperature fatigue after working, which hot-rolled stainless steel sheet has a crystal grain size of not greater than 50 μm on its surface after hot rolling and subsequent annealing, and a structure composed entirely of recrystallized grains over a central portion of the stainless steel sheet extending from the surface of the latter in a direction perpendicular to the thickness of the latter.

The above and other objects, features and advantages of the present invention will become manifest to those versed in the art upon making reference to the following description and accompanying drawings.

DETAILED DESCRIPTION OF THE INVENTION

Figure 1:
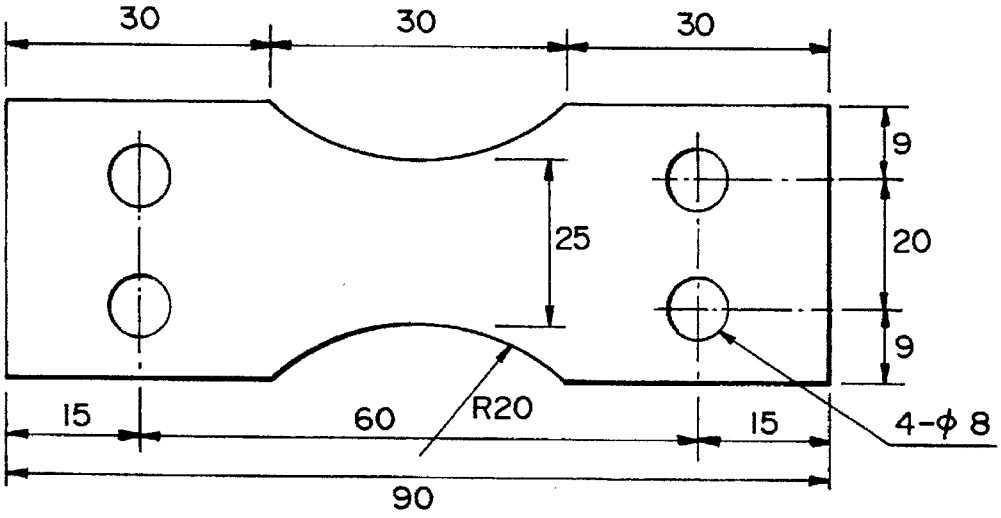
FIG. 1 is a view of a specimen for Schenk's high-temperature plane flexural fatigue test.

Focusing on the foregoing problems of the prior art, the present inventors have done continued research and have ultimately discovered that even where cold rolling is omitted from a series of process steps in common use, a stainless steel sheet can be obtained with excellent resistance to surface roughening and to high-temperature fatigue after working as well as good workability.

The present invention is directed to incorporating various selected elements in their respective specific amounts into a ferrite type stainless steel. In particular, the amounts of solid solutions of C and N in the stainless steel are reduced by adding Ti or Nb in a specified amount such that C and N are effectively fixed with the result that improved workability can be achieved. Moreover, the invention contemplates making microcrystalline the crystal grains of the stainless steel sheet after hot rolling and annealing with both V and B added in specified amounts and also setting the maximum crystal grain size at not greater than 50 μm on the sheet surface with the crystal growth prevented after recrystallization, thereby achieving improved resistance to surface roughening after working.

Based upon the research done by the present inventors, the following elemental requirements need to be strictly observed to obtain a hot-rolled stainless steel sheet having not only excellent resistance to surface roughening and to high-temperature fatigue after working but also sufficient working performance even in the case of omission of cold rolling and its ensuing process steps.

The ferrite-type hot-rolled stainless steel sheet of the present invention should be made up of a specific chemical composition as defined in the appended claims. The reasoning will now be described below in detail.

C: not more than 0.03% by weight

C should preferably be reduced to as low a level as possible since it is an element prone to impair the workability (r value) and corrosion resistance of the finished ferrite type hot-rolled stainless steel sheet. Furthermore, the amount of C in solid solution in a steel stock should preferably be reduced as much as possible, in order for V to assume its role as described later. In the practice of the present invention, C is fixed by adding Ti alone or in combination with Nb, thereby alleviating detrimental effects upon the workability of the resultant steel sheet and upon the stability of the ferrite, and thus allowing V to fully exert its desirable effects. Contents of C exceeding 0.03% by weight lead to increased deposition of carbides in the steel sheet, resulting in reduced workability and deteriorated surface properties of the steel sheet. Thus, C should be present in a content of not more than 0.03% by weight, preferably less than 0.015% by weight, in the steel sheet.

Si: not more than 2.0% by weight

Si is an element effective for deoxidizing a desired stainless steel and also for improving the resistance to high-temperature oxidation and to high-temperature corrosion by salt of the steel. Contents of Si beyond 2.0% by weight invite reduced elongation of the steel sheet, and hence, this element should be in a content of not more than 2.0% by weight in the steel.

Contents of not less than 0.6% by weight of Si are preferred for use in automotive exhaust parts.

Mn: not more than 0.8% by weight

Mn is an element that acts to deposit and fix S in a desired stainless steel to thereby improve the hot rolling capability of the steel, but which tends to deteriorate the working performance of the resultant steel sheet. Thus, Mn should be present in a content of not more than 0.8% by weight, preferably less than 0.5% by weight, in the steel sheet.

S: not more than 0.03% by weight

S is a detrimental element liable to impair the hot rolling workability of a given stainless steel. When the content is more than 0.03% by weight in the steel, S usually forms MnS together with Mn and hardly poses adverse effects. However, when S exceeds 0.03% by weight, MnS deposited causes first rusting to thereby deteriorate the corrosion resistance of the finished steel sheet and also develops into crystal grain boundaries to thereby make the grain boundaries more brittle. Thus, S should be present in a content of not more than 0.03% by weight, preferably less than 0.005% by weight, in the steel.

Cr: 6 to 25% by weight

Cr is an element absolutely necessary for improving the resistance to corrosion and to high-temperature oxidation of a desired stainless steel. Contents of Cr less than 6% by weight produce no significant results, whereas contents of this element more than 25% by weight result in reduced workability of the steel sheet as well as increased cost of the starting steel stock. Thus, Cr should range in content from 6 to 25% by weight in the steel.

Contents of not more than 15% by weight of Cr are preferred for applications where workability is taken as primary and contents of not less than 10% by weight of this element for applications where corrosion resistance at normal temperature is required.

N: not more than 0.03% by weight

N is an element liable to reduce the workability (r value) of a given stainless steel sheet as is the case with C, and hence, N should preferably be decreased to as great an extent as possible. The amount of N in solid solution should also preferably be reduced as much as possible, to allow B to afford its desirable effects as discussed hereinafter. According to the present invention, N is fixed by adding Ti alone or together with Nb to thereby preclude physical deterioration of the steel. More than 0.03% by weight of N is responsible for poor workability of the steel sheet because of increasing deposition of nitrides. Thus, N should be present in a content of not more than 0.03% by weight, preferably less than 0.01% by weight, in the steel.

Al: not more than 0.3% by weight

Al is an element effective for deoxidizing but excess Al results in deteriorated workability of a given stainless steel sheet after hot rolling and annealing. Thus, this element should be present in a content of not more than 0.3% by weight, preferably less than 0.1% by weight, in the steel.

Ti: not more than 0.4% by weight

Ti is a strong element capable of stabilizing C and N to thereby improve the workability of a desired stainless steel sheet and also of preventing carbides and nitrides of Cr from getting deposited in grain boundaries to thereby improve the corrosion resistance of the steel. To this end, Ti needs to be added in such an amount as to satisfy certain specific correlations with C and N as described below. Contents of Ti of larger than 0.4% by weight may conversely render the resultant steel sheet less workable and bring about a sharp decline in workability of weld zone. Thus, Ti should be in a content of not more than 0.4% by weight in the steel.

V: 0.02 to 0.4% by weight

B: 0.0002 to 0.0050% by weight and V/B>10

V and B are extremely important elements in implementing the present invention. When V and B are added in amounts, respectively, of 0.02 to 0.4% by weight and 0.0002 to 0.0050% by weight with the ratio V/B>10 being satisfied, the two elements act to effectively microcrystallize the crystal grains of a desired stainless steel sheet after hot rolling and annealing, and to prevent grain growth after recrystallization.

Although the reason for the above beneficial effects is not exactly known, V would presumably remain as a solid solution in ferrite grains to thereby microcrystallize recrystallized grains during annealing and prevent growth of such grains, while B would probably concentrate into ferrite boundaries and retard travel of the latter to thereby aid in preventing the grain growth. Those effects are variable with the ratio of V to B, and this is probably because of the balance between the volume of ferrite grains and the area of ferrite grain boundaries. The microcrystallization of crystal grains contributes greatly to enhanced resistance to surface roughening of a desired stainless steel sheet after working and also to improved fatigue properties of those steel materials which are subjected to mechanical vibration under high-temperature and rapid-cycle conditions, for example, automotive exhaust parts (exhaust pipes and the like).

The improved fatigue properties achievable through the microcrystallization of crystal grains are believed attributable to the following reasons.

1) Roughened surface after working can be alleviated which is apt to cause breakage due to stresses localized thereon.

2) Grain boundaries are highly susceptible to localized stresses and provide the passage of crack propagation. Microcrystallization of the grain boundaries provides increased area of the same, relaxing localized stresses per unit of grain boundary.

3) Concentration of B into the grain boundaries affords reinforced strength of the latter.

Here, where C is not fully deposited and fixed by Ti and Nb, V reacts with C and deposits as $V_2C$ or VC, failing to sufficiently prevent grain growth. In the case of insufficient deposition and fixing of N by Ti, B reacts with N and deposits as BN, adversely facilitating grain growth.

C should therefore be deposited and fixed by adding ample amounts of Ti and Nb, i.e., stronger carbide-forming elements than V. N should be likewise treated by adding an ample amount of Ti, i.e., a stronger nitride-forming element than V and B.

In addition to the foregoing beneficial effects accruing from addition of B, this element has an additional role to facilitate accumulation of strains during hot rolling and to promote collection of {111} planes as regards a recrystallization texture after annealing, contributing to improved workability of a desired hot-rolled stainless steel sheet. Hence, the addition of B is especially important for a hot-rolled stainless steel sheet that is otherwise less workable than a cold-rolled equivalent.

The desired effects of V and B discussed above are achievable only where V is present in a content of not less than 0.02% by weight, B is present in a content of not less than 0.0002% by weight, and V and B meet the ratio V/B>10. V and B in excessive amounts, i.e., greater than 0.4% by weight and 0.0050% by weight, respectively, yield no better results of microcrystallizing crystal grains during annealing, preventing grain growth and improving workability. Conversely, the resulting stainless steel sheet becomes too hard, less elongated and less workable with higher amounts of V and B. Thus, V should be in a content of 0.02 to 0.4% by weight, B should be in a content of 0.0002 to 0.0050% by weight, and V and B should satisfy the ratio V/B>10 in the steel.

Nb: not more than 0.5% by weight

Nb is an element capable of stabilizing C and N. Nb cooperates with Ti in improving the workability of a desired stainless steel sheet and also in preventing carbides and nitrides of Cr from becoming deposited in grain boundaries, giving improved corrosion resistance to the steel sheet. For Nb to afford these desirable effects, this element needs to be added in an amount to satisfy certain specific correlations with C and N as explained hereunder. Contents of Nb exceeding 0.5% by weight result in reduced workability of the steel sheet and impaired workability of weld zone and heat affected zone (HAZ). Thus, Nb should be in a content of not more than 0.5% by weight in the steel. When Nb is used in combination with Ti, the two elements should preferably be not more than 0.6% by weight in terms of Ti+Nb.

Ti/48>N/14+C/12 or

Ti/48>N/14 and Ti/48+Nb/92>N/14+C/12

Ti and Nb are added to ensure that the desired effects of V and B stated hereinbefore are achieved; that is, N is deposited and fixed as TiN and C as TiC or NbC. Stoichiometrically, Ti when employed alone should be in a content to satisfy Ti/48>N/14+C/12, and Ti and Nb when used in combination should be in a content to satisfy both Ti/48>N/14 and Ti/48+Nb/92>N/14+C/12, each such case being in the steel.

The hot-rolled stainless steel sheet of the present invention may also contain, where desired, the following elements.

Ca: not more than 0.01% by weight

Ca is an element effective to form CaS in a molten steel stock to thereby prevent clogging of nozzles caused by TiS inclusions prone to arise during casting of a Ti-containing molten steel stock. Excess Ca results in reduced corrosion resistance of steel sheet. Ca should be in a content of not more than 0.01% by weight, preferably in a range of $S \leqq (32/40)\,Ca \leqq 1.5\,S$ (that is, mole ratio Ca/S between 1 and 1.5) in a desired stainless steel.

Mo: not more than 2.0% by weight

Mo is effective for further improving the corrosion resistance of a given stainless steel. Contents of Mo above 2.0% by weight invite reduced hot rolling workability. Thus, Mo should be in a content of not more than 2.0% by weight in the steel.

Cu: not more than 0.4% by weight

Cu acts to further improve the corrosion resistance of a desired stainless steel sheet. Increasing contents of Cu cause largely varied grain sizes during annealing of the steel sheet after hot rolling, making crystal grain size less controllable. When the content is more than 0.4% by weight of Cu, the welded parts and heat affected zone become brittle, and thus this element should be in a content of not more than 0.4% by weight in the steel sheet.

P, like Pb and Sn, causes frequent hot fracture of a given stainless steel, thereby impairing the hot rolling working and toughness of the steel. Thus, the content of P should be not more than 0.03% by weight in the steel.

The hot-rolled stainless steel sheet of the present invention may be produced preferably by hot-rolling a starting stainless steel stock at a heating temperature of 1,250° to 1,050° C., at a finishing temperature of 900° to 600° C. and at a coiling temperature of lower than 700° C., and subsequently by annealing the resulting hot-rolled coil at a temperature of 800° to 1,100° C.

The present invention will be further described below in greater detail with reference to the following examples.

Steels composed as shown in Table 1, No. 1 through No. 23, were melted and cast in a 30 kg vacuum melting furnace. Each of the resultant small slab was re-heated at 1,250° C., followed by hot rolling at a finishing temperature of 700° C. with a rolling pass number of 8, whereby a 2 mm-thick hot-rolled steel sheet was produced. The steel sheet was annealed for 60 seconds at the temperature shown in Table 2 and was thereafter pickled.

TABLE 1

Steel Composition

| Steel No. | C | Si | Mn | S | Cr | N | Al | Ti | Nb | V | B | Ca | Mo | Cu | Example |
|---|---|---|---|---|---|---|---|---|---|---|---|---|---|---|---|
| 1 | 0.013 | 0.75 | 0.15 | 0.004 | 11.1 | 0.010 | 0.12 | 0.28 | — | ≦0.001 | 0.0001 | — | — | — | Comparative Ex. |
| 2 | 0.015 | 0.71 | 0.18 | 0.005 | 11.1 | 0.012 | 0.10 | 0.29 | — | 0.107 | 0.0001 | — | — | — | Comparative Ex. |
| 3 | 0.017 | 0.74 | 0.18 | 0.004 | 11.1 | 0.012 | 0.10 | 0.26 | — | 0.002 | 0.0011 | — | — | — | Comparative Ex. |
| 4 | 0.016 | 0.74 | 0.16 | 0.004 | 11.1 | 0.012 | 0.11 | 0.29 | — | 0.110 | 0.0007 | — | — | — | Inventive Ex. |
| 5 | 0.013 | 0.72 | 0.14 | 0.004 | 11.1 | 0.012 | 0.12 | 0.16 | — | 0.095 | 0.0005 | 0.0061 | — | — | Inventive Ex. |
| 6 | 0.020 | 1.00 | 0.22 | 0.002 | 14.9 | 0.020 | 0.15 | 0.10 | 0.33 | ≦0.001 | 0.0001 | — | — | — | Comparative Ex. |
| 7 | 0.020 | 1.00 | 0.25 | 0.003 | 14.9 | 0.020 | 0.15 | 0.10 | 0.34 | 0.015 | 0.0030 | — | — | — | Comparative Ex. |

| Steel No. | Ti/48 + Nb/92 − N/14 − C/12 | Ti/48 − N/14 | V/B | Example |
|---|---|---|---|---|
| 1 | 0.0040 | 0.0051 | — | Comparative Ex. |
| 2 | 0.0039 | 0.0052 | 1070.0 | Comparative Ex. |
| 3 | 0.0036 | 0.0050 | 1.8 | Comparative Ex. |
| 4 | 0.0039 | 0.0052 | 157.1 | Inventive Ex. |
| 5 | 0.0014 | 0.0025 | 190.0 | Inventive Ex. |
| 6 | 0.0026 | 0.0007 | — | Comparative Ex. |
| 7 | 0.0027 | 0.0007 | 5.0 | Comparative Ex. |

| Steel No. | C | Si | Mn | S | Cr | N | Al | Ti | Nb | V | B | Ca | Mo | Cu | Example |
|---|---|---|---|---|---|---|---|---|---|---|---|---|---|---|---|
| 8 | 0.022 | 0.95 | 0.26 | 0.003 | 14.8 | 0.017 | 0.16 | 0.08 | 0.34 | 0.036 | 0.0018 | — | — | — | Inventive Ex. |
| 9 | 0.019 | 0.95 | 0.25 | 0.004 | 15.1 | 0.015 | 0.14 | 0.09 | 0.36 | 0.050 | 0.0004 | — | — | — | Inventive Ex. |
| 10 | 0.021 | 0.94 | 0.25 | 0.002 | 15.2 | 0.015 | 0.14 | 0.09 | 0.35 | 0.225 | 0.0006 | — | — | — | Inventive Ex. |
| 11 | 0.021 | 0.94 | 0.24 | 0.002 | 15.2 | 0.015 | 0.16 | 0.09 | 0.36 | 0.400 | 0.0071 | — | — | — | Comparative Ex. |
| 12 | 0.019 | 0.97 | 0.25 | 0.003 | 15.1 | 0.018 | 0.16 | 0.10 | 0.35 | 0.570 | 0.0018 | — | — | — | Comparative Ex. |
| 13 | 0.008 | 0.41 | 0.30 | 0.009 | 17.8 | 0.011 | 0.08 | 0.25 | 0.01 | ≦0.001 | 0.0001 | 0.0018 | — | — | Comparative Ex. |
| 14 | 0.038 | 0.45 | 0.28 | 0.008 | 17.8 | 0.016 | 0.09 | 0.26 | 0.02 | 0.080 | 0.0005 | 0.0011 | — | — | Comparative Ex. |
| 15 | 0.006 | 0.45 | 0.29 | 0.009 | 17.6 | 0.014 | 0.09 | 0.010 | 0.38 | 0.090 | 0.0014 | 0.0009 | — | — | Comparative Ex. |

| Steel No. | Ti/48 + Nb/92 − N/14 − C/12 | Ti/48 − N/14 | V/B | Example |
|---|---|---|---|---|
| 8 | 0.0023 | 0.0005 | 20.0 | Inventive Ex. |
| 9 | 0.0031 | 0.0008 | 125.0 | Inventive Ex. |
| 10 | 0.0029 | 0.0008 | 375.0 | Inventive Ex. |

TABLE 1-continued

| Steel Composition | | | | | | | | | | | | | | | |
|---|---|---|---|---|---|---|---|---|---|---|---|---|---|---|---|
| 11 | | | | 0.0030 | | | | | 0.0008 | | | 56.3 | | | Comparative Ex. |
| 12 | | | | 0.0030 | | | | | 0.0008 | | | 316.7 | | | Comparative Ex. |
| 13 | | | | 0.0039 | | | | | 0.0044 | | | — | | | Comparative Ex. |
| 14 | | | | 0.0013 | | | | | 0.0043 | | | 160.0 | | | Comparative Ex. |
| 15 | | | | 0.0029 | | | | | −0.0008 | | | 64.3 | | | Comparative Ex. |
| Steel No. | C | Si | Mn | S | Cr | N | Al | Ti | Nb | V | B | Ca | Mo | Cu | Example |
| 16 | 0.009 | 0.44 | 0.28 | 0.008 | 17.9 | 0.019 | 0.07 | 0.28 | 0.01 | 0.050 | 0.0040 | 0.0008 | — | — | Inventive Ex. |
| 17 | 0.008 | 0.44 | 0.31 | 0.007 | 17.8 | 0.017 | 0.09 | 0.29 | 0.02 | 0.220 | 0.0032 | 0.0006 | — | — | Inventive Ex. |
| 18 | 0.009 | 0.44 | 0.30 | 0.007 | 17.6 | 0.016 | 0.07 | 0.31 | 0.01 | 0.350 | 0.0025 | 0.0009 | — | — | Inventive Ex. |
| 19 | 0.004 | 0.45 | 0.30 | 0.008 | 17.9 | 0.019 | 0.08 | 0.30 | 0.01 | 0.380 | 0.0008 | 0.0007 | — | — | Inventive Ex. |
| 20 | 0.007 | 0.43 | 0.28 | 0.004 | 17.7 | 0.020 | 0.07 | 0.24 | 0.01 | 0.110 | 0.0006 | 0.0090 | 1.30 | — | Inventive Ex. |
| 21 | 0.008 | 0.45 | 0.30 | 0.004 | 17.7 | 0.011 | 0.08 | 0.25 | 0.01 | 0.200 | 0.0044 | 0.0012 | — | 0.32 | Inventive Ex. |
| 22 | 0.011 | 0.40 | 0.28 | 0.003 | 17.5 | 0.015 | 0.08 | 0.26 | 0.02 | 0.240 | 0.0030 | 0.0022 | — | 0.90 | Comparative Ex. |
| 23 | 0.008 | 0.45 | 0.30 | 0.004 | 17.9 | 0.018 | 0.10 | 0.25 | 0.01 | 0.250 | 0.0040 | 0.0056 | 0.80 | 0.40 | Inventive Ex. |

| Steel No. | Ti/48 + Nb/92 − N/14 − c/12 | Ti/48 − N/14 | V/B | Example |
|---|---|---|---|---|
| 16 | 0.0038 | 0.0045 | 12.5 | Inventive Ex. |
| 17 | 0.0044 | 0.0048 | 68.8 | Inventive Ex. |
| 18 | 0.0047 | 0.0053 | 140.0 | Inventive Ex. |
| 19 | 0.0047 | 0.0049 | 475.0 | Inventive Ex. |
| 20 | 0.0031 | 0.0036 | 183.3 | Inventive Ex. |
| 21 | 0.0039 | 0.0044 | 45.5 | Inventive Ex. |
| 22 | 0.0036 | 0.0043 | 109.0 | Comparative Ex. |
| 23 | 0.0034 | 0.0039 | 62.5 | Inventive Ex. |

TABLE 2

| Experiment No. | Steel No. | Annealing Temperature (°C.) | Maximum grain size on sheet surface (μm) | Surface roughness Ra(μm) | Threshold fatigue stress (Mpa) | Elongation (%) | r value | Example |
|---|---|---|---|---|---|---|---|---|
| 1a | 1 | 850 | 33 | 2.9 | 68 | 22 | 0.38 | Comparative |
| 1b | 1 | 900 | 78 | 7.3 | 65 | 36 | 0.75 | Comparative |
| 1c | 1 | 950 | 110 | 9.2 | 60 | 38 | 0.79 | Comparative |
| 2 | 2 | 900 | 67 | 4.6 | 68 | 35 | 0.74 | Comparative |
| 3 | 3 | 900 | 70 | 6.8 | 68 | 35 | 0.94 | Comparative |
| 4a | 4 | 900 | 23 | 2.5 | 78 | 38 | 1.02 | Inventive |
| 4b | 4 | 950 | 45 | 2.6 | 73 | 41 | 1.13 | Inventive |
| 5 | 5 | 900 | 30 | 2.4 | 73 | 37 | 1.04 | Inventive |
| 6a | 6 | 950 | 26 | 3.5 | 88 | 27 | 0.44 | Comparative |
| 6b | 6 | 1000 | 82 | 7.8 | 81 | 35 | 0.87 | Comparative |
| 7 | 7 | 1000 | 79 | 6.2 | 82 | 36 | 0.95 | Comparative |
| 8 | 8 | 1000 | 38 | 2.6 | 95 | 38 | 1.17 | Inventive |
| 9 | 9 | 1000 | 30 | 2.5 | 90 | 38 | 1.05 | Inventive |
| 10 | 10 | 1000 | 26 | 2.1 | 92 | 36 | 1.11 | Inventive |
| 11 | 11 | 1000 | 38 | 2.7 | 90 | 25 | 0.67 | Comparative |
| 12 | 12 | 1000 | 28 | 2.7 | 90 | 23 | 0.67 | Comparative |
| 13 | 13 | 1050 | 77 | 10.5 | 82 | 34 | 0.74 | Comparative |
| 14 | 14 | 1050 | 55 | 6.4 | 78 | 27 | 0.65 | Comparative |
| 15 | 15 | 1050 | 93 | 8.1 | 92 | 30 | 0.78 | Comparative |
| 16 | 16 | 1050 | 32 | 3.9 | 92 | 33 | 1.26 | Inventive |
| 17 | 17 | 1050 | 30 | 3.4 | 97 | 35 | 1.38 | Inventive |
| 18a | 18 | 1050 | 38 | 3.3 | 95 | 33 | 1.19 | Inventive |
| 18b | 18 | 1100 | 45 | 4.6 | 91 | 34 | 1.34 | Inventive |
| 19 | 19 | 1050 | 20 | 3 | 91 | 30 | 1.08 | Inventive |
| 20 | 20 | 1050 | 42 | 3.6 | 97 | 33 | 1.22 | Inventive |
| 21 | 21 | 1050 | 23 | 3.4 | 94 | 33 | 1.15 | Inventive |
| 22 | 22 | 1050 | 60 | 7.8 | 83 | 31 | 1.02 | Comparative |
| 23 | 23 | 1050 | 21 | 3.8 | 99 | 31 | 1.08 | Inventive |

A JIS No. 13B specimen for tensile testing was cut along the direction of rolling, from each of the above steel sheets after hot rolling and subsequent annealing. Measurement was made of r value by a three-point method after the specimen was subjected to a tensile strain of 15%. The specimens were then checked for surface roughness (Ra) in the direction of rolling as a measure of surface roughening. Thereafter, each specimen was stretched to breakage, to determine its elongation at break (El).

Figure 2:
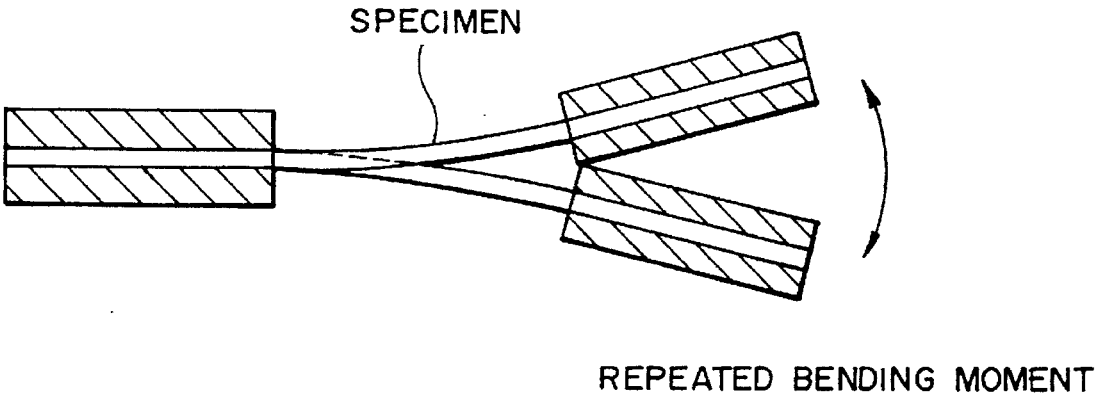
FIG. 2 is a schematic view explanatory of the principles of Schenk's test referred to in FIG. 1.
Figure 3:
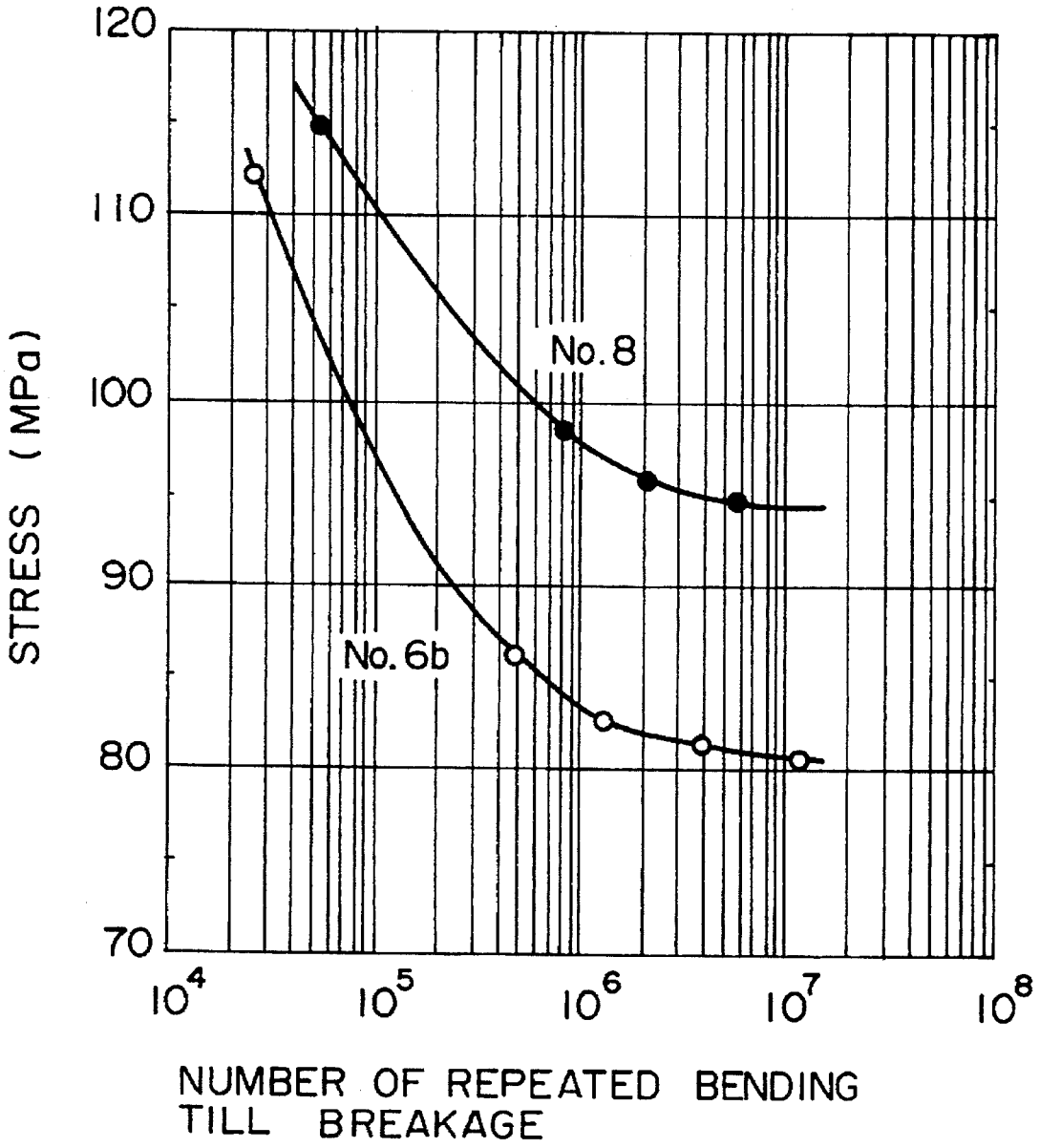
FIG. 3 is a graphic representation of the relationship between the breakage lifetime and threshold fatigue stress with respect to two, inventive and comparative, hot-rolled stainless steel sheets subjected to the high-temperature fatigue test.

High-temperature fatigue properties were evaluated with use of the specimen shown in FIG. 1 and Schenk's high-temperature plane flexural testing apparatus in which bending moment was imparted at a test temperature of 700° C. and at a test speed of 1,700 cycles/minute. The general principles of the test method are illustrated in FIG. 2 in which the specimen was exposed at its one free end to repeated bending moments, with the other end firmly secured. FIG. 3 shows, as one of various experiments, the test results flowing from No. 8 (inventive) and No. 6b (comparative). From these test results, the stress required for breakage life to reach a cycle of $10^7$ was computed (the stress being hereunder called "threshold fatigue stress").

By the foregoing procedures, performance evaluation was made of workability (r value and elongation at break), surface roughening (Ra) and high-temperature fatigue properties (threshold fatigue stress) with the results shown in Table 2. The test steel sheet was inspected on its surface structure in an area of 1,000 μm×1,000 μm to determine the crystal grain sizes, with the maximum grain size being listed also in Table 2.

Steel Nos. 1 to 5 were of a system containing 11% by weight of Cr. Experiment No. 1a, using Steel No. 1 that was made too low in the amounts of V and B and annealed at 850° C., revealed a small crystal grain size of 33 μm at most on its annealed surface. However, No. 1a exhibited, owing to the low annealing temperature, a hot-rolled band structure in a central portion of the sheet thickness, and failed to fully recrystallize, this displaying with low elongation and low r value and hence insufficient workability.

In Experiment No. 1b, Steel No. 1 annealed at 900° C. was satisfactory in respect of workability with high elongation and adequate r value, but had an excessively roughened surface after working. In Experiment No. 1c, Steel No. 1 annealed at a higher temperature of 950° C. had a yet rougher surface and moreover reduced threshold fatigue stress, say a 7.7% drop as compared to No. 1b annealed at a temperature high enough to meet with the workability requirement, hence involving reduced high-temperature fatigue properties. In Experiment No. 2, Steel No. 2 made with too little B and annealed at 900° C., was slightly higher in surface roughening resistance and high-temperature fatigue properties than Steel No. 1 in Experiment No. 1b, but not significantly so. Similar results were obtained for Experiment No. 3, in which Steel No. 3 contained too little V.

Experiment No. 4a, in which Steel No. 4 (inventive) was annealed at 900° C., exhibits not only sufficient workability with full recrystallization up to a central portion of the sheet thickness, but also a noticeable rise in surface roughening resistance with a microcrystalline crystal grain size of 23 μm at the largest and a surface roughness of Ra=2.5 μm. Moreover, Steel No. 4 is excellent in high-temperature fatigue properties with a threshold fatigue stress of 78 MPa that is greater by 20% than Steel No. 1 in Experiment No. 1b (comparative). Steel No. 4 was also annealed at 950° C. (Experiment No. 4b). The annealing temperature of 950° C. is by far higher than the recrystallization temperature for a 11% Cr—Ti system. At that annealing temperature Experiment No. 1c led to a sharp decline, owing to its crystal grain coarseness, in surface roughening resistance and high-temperature fatigue properties, whereas Steel No. 4 in Experiment No. 4b has been found to be excellent in workability, surface roughening resistance and high-temperature fatigue properties. In consequence, the steel according to the invention has a wide range of annealing temperatures that produce satisfactory workability, surface roughening resistance and high-temperature fatigue properties, hence contributing greatly to improved productivity and simple control by relatively unskilled labor.

In the 11% Cr system above, Ca when added is also effective in improving workability, surface roughening resistance and high-temperature fatigue properties as is evident from Steel No. 5 (inventive).

Steel Nos. 6 to 12 were of a 15% Cr system having Ti—Nb added in combination. Steel No. 6, having too little V and B and annealed at 950° C. (Experiment No. 6a), was low in elongation and r value with insufficient recrystallization at a central portion of the sheet thickness. Annealing at 1,000° C. (Experiment No. 6b) allowed recrystallization to proceed up to a central portion of the sheet thickness, but caused the recrystallized crystal grain to grow up to 82 μm, resulting in worsened surface roughening resistance and high-temperature fatigue properties. No. 7, made up of too low a V/B ratio despite the addition of V and B, was slightly superior in surface roughening resistance and high-temperature fatigue properties to No. 6b, but to a degree without appreciable significance.

Steel Nos. 8 to 10, all according to the present invention, and that were composed of Steel No. 6 and V and B added together, are acceptable in workability with full recrystallization up to a central portion of the sheet thickness, and in surface roughening resistance (Ra: less than 3.0 μm) with microcrystalline crystal grains on the sheet surface, and also in high-temperature fatigue properties (threshold fatigue stress: more than 90 MPa, a 11% increase as against No. 6b).

No. 11 that was a comparative example and contained excess B, and No. 12 that was a comparative example and contained excess V involved in both cases reduced workability (elongation and r value).

Steel Nos. 13 to 22 were of a 18% Cr system. No. 13, which had too little V and B, revealed reduced surface roughening resistance and high-temperature fatigue properties with crystal grains grown up to 78 μm on the sheet surface. No. 14 in which C was excessive was inferior in workability at normal temperature and also in low surface roughening resistance and high-temperature fatigue properties. No. 15 in which Ti was too low relative to N was unacceptable in surface roughening resistance.

Nos. 16, 17, 18a and 19, all inventive, are excellent in surface roughening resistance and high-temperature fatigue properties. Experiment No. 18b annealed at a higher temperature of 1,100° C., yet produced adequately controlled crystal grain of 45 μm at the largest and thus shows better workability, surface roughening resistance and high-temperature fatigue properties than No. 13 that was a comparative example and was annealed at 1,050° C.

The tendency noted above has been confirmed in the cases (Nos. 20, 21 and 23) in which corrosion resistance was improved by the addition of Mo and Cu. However, No. 22 in which the amount of Cu departed from the scope of the invention proved unacceptable, though satisfactory in respect of workability, in regard to surface roughening resistance with crystal grains partially grown up to about 60 μm on the sheet surface.

According to the present invention, as described and shown hereinabove, a ferrite-type hot-rolled stainless steel sheet is provided which excels in workability, surface roughening resistance and high-temperature fatigue properties after working even with cold rolling and its subsequent process steps omitted. Thus, such steel sheet is suitably useful for automotive exhaust components which have heretofore been dominated by an expensive cold-rolled stainless steel sheet.

Furthermore, a range of annealing temperatures according to the invention is so wide that the above steel sheet is producible with utmost ease.

What is claimed is:

1. A ferrite-type hot-rolled stainless steel sheet that has excellent resistance to surface roughening and to high-temperature fatigue after working, which stainless steel comprises, by weight, C in a content of not more than 0.03%, Si in a content of not more than 2.0%, Mn in a content of not more than 0.8%, S in a content of not more than 0.03%, Cr in a content of from 6 to 25%, N in a content of not more than 0.03%, Al in a content of not more than 0.3%, Ti in a content of not more than 0.4%, V in a content of from 0.02 to 0.4% and B in a content of from 0.0002 to 0.0050%, wherein Ti/48>N/14+C/12 and

V/B>10, balance being Fe and inevitable impurities.

2. A ferrite-type hot-rolled stainless steel sheet that has excellent resistance to surface roughening and to high-temperature fatigue after working, which stainless steel comprises, by weight, C in a content of not more than 0.03%, Si in a content of not more than 2.0%, Mn in a content of not more than 0.8%, S in a content of not more than 0.03%, Cr in a content of from 6 to 25%, N in a content of not more than 0.03%, Al in a content of not more than 0.3%, Ti in a content of not more than 0.4%, V in a content of from 0.02 to 0.4%, B in a content of from 0.0002 to 0.0050% and Nb in a content of not more than 0.5%, wherein Ti/48>N/14

Ti/48+Nb/92>N/14+C/12 and

V/B>10, balance being Fe and inevitable impurities.

3. A ferrite-type hot-rolled stainless steel sheet that has excellent resistance to surface roughening and to high-temperature fatigue after working, which stainless steel comprises, by weight, C in a content of not more than 0.03%, Si in a content of not more than 2.0%, Mn in a content of not more than 0.8%, S in a content of not more than 0.03%, Cr in a content of from 6 to 25%, N in a content of not more than 0.03%, Al in a content of not more than 0.3%, Ti in a content of not more than 0.4%, V in a content of from 0.02 to 0.4% and B in a content of from 0.0002 to 0.0050%, wherein Ti/48>N/14+C/12 and

V/B>10, the stainless steel further including, by weight, at least one member selected from the group consisting of the following elements, Ca in a content of not more than 0.01%, Mo in a content of not more than 2.0% and Cu in a content of not more than 0.4%, balance being Fe and inevitable impurities.

4. A ferrite-type hot-rolled stainless steel sheet that has excellent resistance to surface roughening and to high-temperature fatigue after working, which stainless steel comprises, by weight, C in a content of not more than 0.03%, Si in a content of not more than 2.0%, Mn in a content of not more than 0.8%, S in a content of not more than 0.03%, Cr in a content of from 6 to 25%, N in a content of not more than 0.03%, Al in a content of not more than 0.3%, Ti in a content of not more than 0.4%, V in a content of from 0.02 to 0.4%, B in a content of from 0.0002 to 0.0050% and Nb in a content of not more than 0.5%, wherein Ti/48>N/14

Ti/48+Nb/92>N/14+C/12 and

V/B>10, the stainless steel further including, by weight, at least one member selected from the group consisting of the following elements, Ca in a content of not more than 0.01%.

Mo in a content of not more than 2.0% and

Cu in a content of not more than 0.4%, the balance being Fe and inevitable impurities.

5. A ferrite-type hot-rolled stainless steel sheet according to claim 1, which has a crystal grain size of not greater than 50 μm on its surface after hot rolling and subsequent annealing, and a structure composed entirely of recrystallized grains over a central portion of the stainless steel sheet from a surface of said sheet along a direction perpendicular to said surface.

6. A ferrite-type hot-rolled stainless steel sheet according to claim 2, which has a crystal grain size of not greater than 50 μm on its surface after hot rolling and subsequent annealing, and a structure composed entirely of recrystallized grains over a central portion of the stainless steel sheet from a surface of said sheet along a direction perpendicular to said surface.

7. A ferrite-type hot-rolled stainless steel sheet according to claim 3, which has a crystal grain size of not greater than 50 μm on its surface after hot rolling and subsequent annealing, and a structure composed entirely of recrystallized grains over a central portion of the stainless steel sheet from a surface of said sheet along a direction perpendicular to said surface.

8. A ferrite-type hot-rolled stainless steel sheet according to claim 4, which has a crystal grain size of not greater than 50 μm on its surface after hot rolling and subsequent annealing, and a structure composed entirely of recrystallized grains over a central portion of the stainless steel sheet from a surface of said sheet along a direction perpendicular to said surface.

9. A ferrite-type hot-rolled stainless steel sheet according to claim 1, wherein C is present in an amount of less than 0.015% by weight, and N is present in an amount of less than 0.01% by weight.

10. A ferrite-type hot-rolled stainless steel sheet according to claim 2, wherein C is present in an amount of less than 0.015% by weight, and N is present in an amount of less than 0.01% by weight.

11. A ferrite-type hot-rolled stainless steel sheet according to claim 3, wherein C is present in an amount of less than 0.015% by weight, and N is present in an amount of less than 0.01% by weight.

12. A ferrite-type hot-rolled stainless steel sheet according to claim 4, wherein C is present in an amount of less than 0.015% by weight, and N is present in an amount of less than 0.01% by weight.

13. A ferrite-type hot-rolled stainless steel sheet according to claim 1, wherein Mn is present in an amount of less than 0.5% by weight, and S is present in an amount of less than 0.005% by weight.

14. A ferrite-type hot-rolled stainless steel sheet according to claim 2, wherein Mn is present in an amount of less than 0.5% by weight, and S is present in an amount of less than 0.005% by weight.

15. A ferrite-type hot-rolled stainless steel sheet according to claim 3, wherein Mn is present in an amount of less than 0.5% by weight, and S is present in an amount of less than 0.005% by weight.

16. A ferrite-type hot-rolled stainless steel sheet according to claim 4, wherein Mn is present in an amount of less than 0.5% by weight, and S is present in an amount of less than 0.005% by weight.

17. A ferrite-type hot-rolled stainless steel sheet according to claim 1, wherein Cr is present in an amount of 10–15% by weight.

18. A ferrite-type hot-rolled stainless steel sheet according to claim 2, wherein Cr is present in an amount of 10–15% by weight.

19. A ferrite-type hot-rolled stainless steel sheet according to claim 3, wherein Cr is present in an amount of 10–15% by weight.

20. A ferrite-type hot-rolled stainless steel sheet according to claim 4, wherein Cr is present in an amount of 10–15% by weight.

* * * * *